US005365676A

United States Patent [19]

Bein

[11] Patent Number: 5,365,676

[45] Date of Patent: Nov. 22, 1994

[54] TWO-STAGE SLUDGE DRYING APPARATUS AND METHOD

[75] Inventor: Daniel J. Bein, Waukesha, Wis.

[73] Assignee: Oven Systems, Inc., Milwaukee, Wis.

[21] Appl. No.: 101,594

[22] Filed: Aug. 2, 1993

[51] Int. Cl.[5] ..... F26B 19/00

[52] U.S. Cl. ..... 34/424; 34/223

[58] Field of Search ..... 110/223, 218, 219; 34/39, 208, 218, 219, 424

[56] References Cited

U.S. PATENT DOCUMENTS 4,827,853 5/1989 Emery .

*Primary Examiner*—Henry A. Bennet

*Attorney, Agent, or Firm*—Andrus, Sceales, Starke & Sawall

[57] ABSTRACT

A system for drying municipal sludge to reduce its moisture content and harmful pathogens to a level suitable for direct land application includes a cellular conveyor belt defining pockets which are filled with moist sludge and which is carried through multiple runs in a drying chamber over heat conducting supporting pans in a manner causing inversion of the sludge filled belt for at least one of the runs. Heated drying air is supplied directly to the sludge from above along each run and indirectly by conduction to the sludge from the supporting pans below along each run to provide uniform and rapid drying with maximum efficiency.

12 Claims, 3 Drawing Sheets

FIG. 2
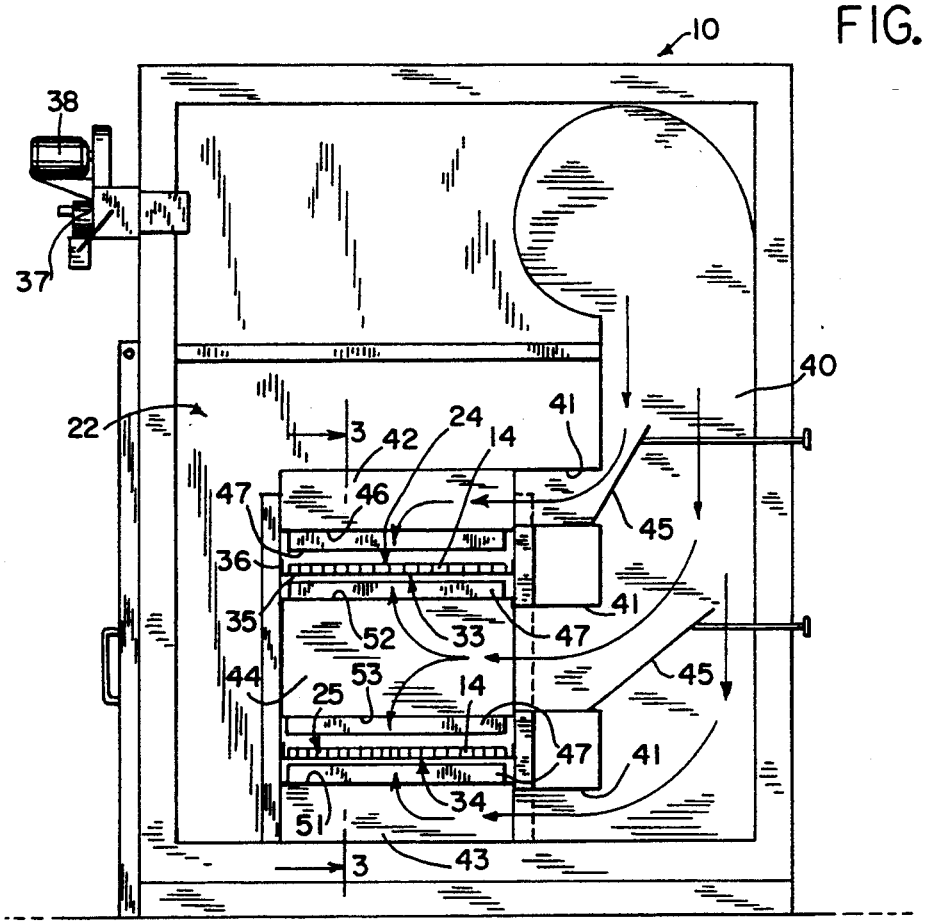
FIG. 3
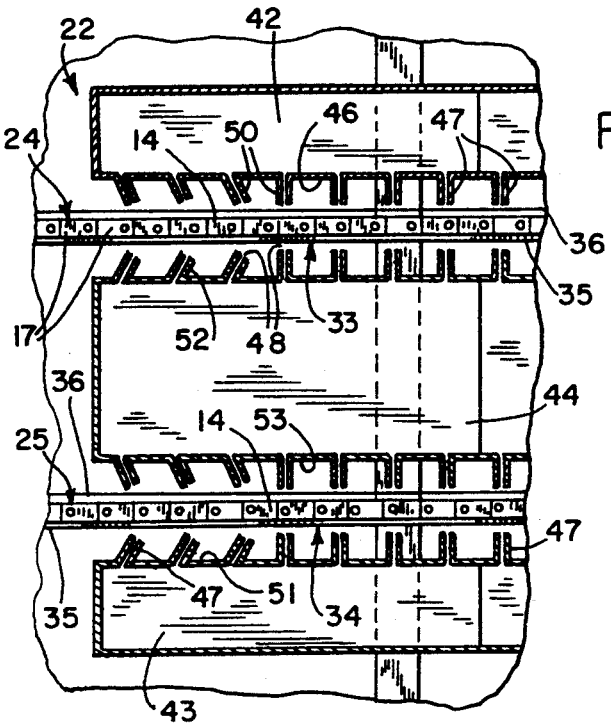
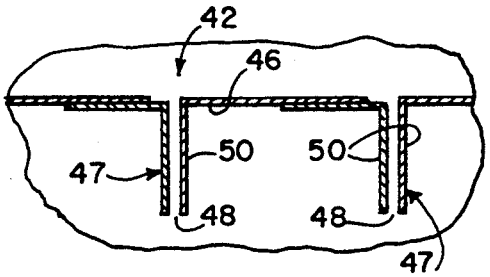
FIG. 4

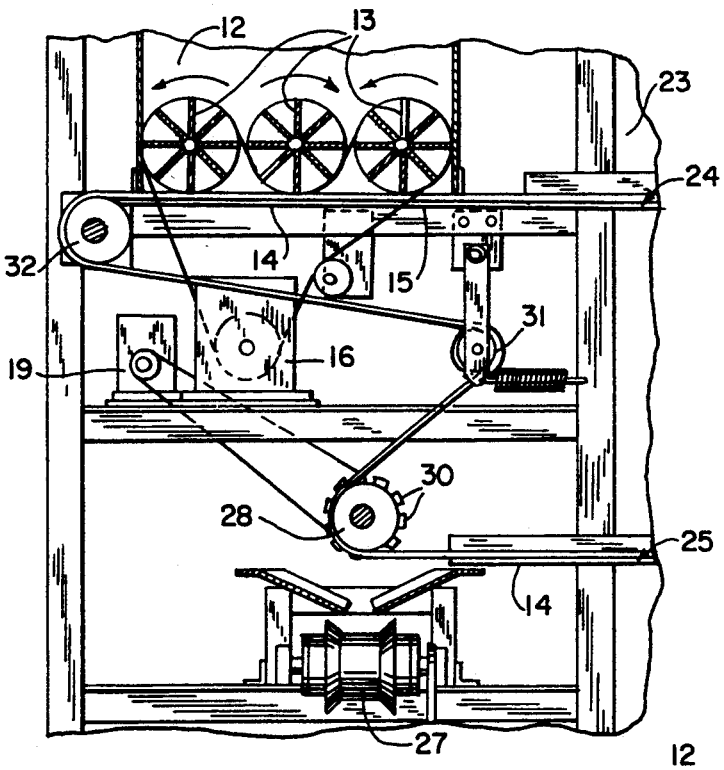
FIG. 6
FIG. 7
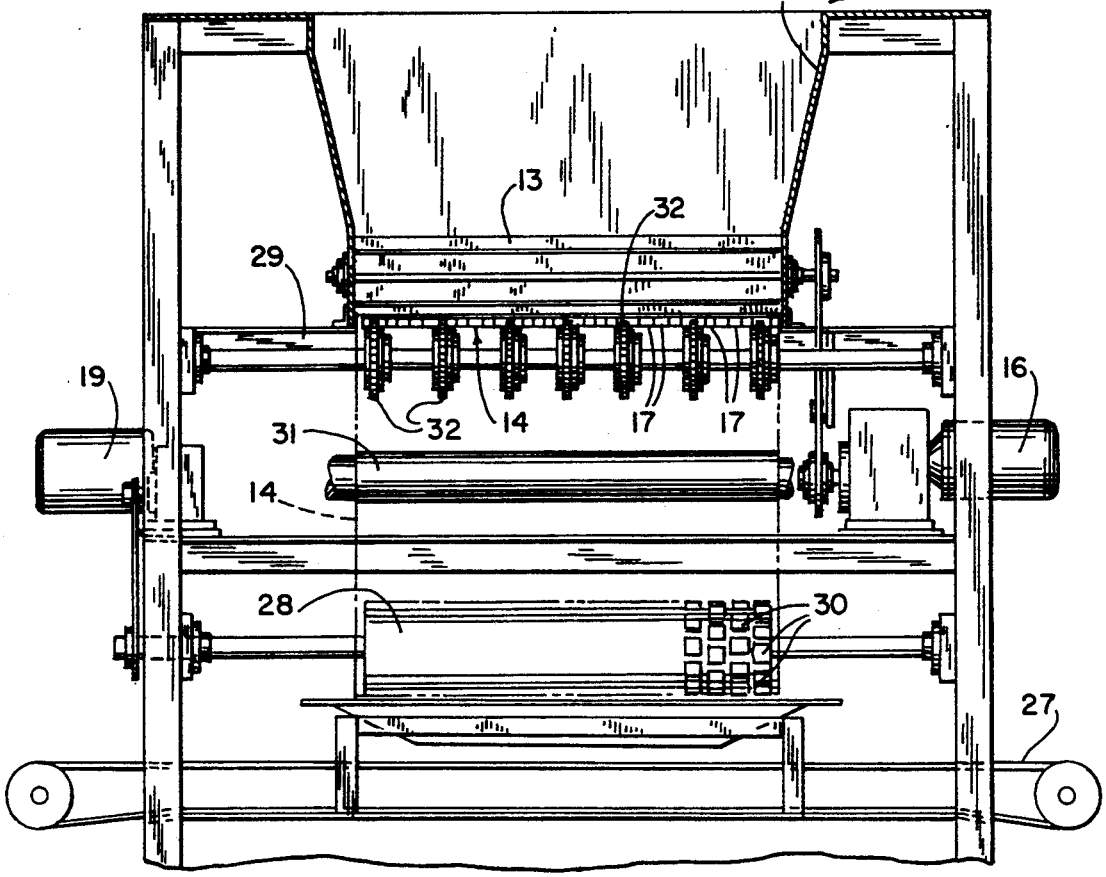

TWO-STAGE SLUDGE DRYING APPARATUS AND METHOD

BACKGROUND OF THE INVENTION

The present invention relates to a process for drying moist sludge and, more particularly, to an improved method and apparatus for rapidly and efficiently drying moist municipal sludge.

The safe and effective disposal of industrial process sludge and municipal sewage sludge has become increasingly more difficult and costly. The applicable standards regulating the permissible pollutant contents, i.e. heavy metals and pathogens, have become more restrictive. Simultaneously, available landfill space has diminished and standards governing other properties of municipal sludge suitable for landfill, such as moisture content, have also become more restrictive.

Federal standards for the use or disposal of sewage sludge, promulgated by the U.S. Environmental Protection Agency, detail the requirements for land application and surface disposal of municipal sewage sludge. Land application of sewage sludge for agronomic purposes, such as agricultural lands and parks, requires rigid compliance with limits on pollutants, pathogens, and water content. The treated sludge must also meet so called vector attraction reduction requirements to minimize the potential for the spread of disease by flies, rodents, birds and the like.

Municipal sewage sludge can be treated by heat drying to meet the required standards for direct land application. If the sludge is dried by hot gas treatment, using either direct or indirect contact, the moisture content of the sludge must be reduced to 10% or less with the temperature of the gas in contact with the sludge maintained at least at 80° C.

U.S. Pat. 4,827,853 describes a system for drying sludge, particularly metal hydroxide sludge, utilizing indirect hot air drying by heat transfer through metal surfaces which support the sludge. In particular, the wet sludge is pressed into pockets formed by the links of a metal conveyor chain belt, the chain is conveyed over a flat metal surface, and the metal surface is heated from below causing the heat to be conducted to the sludge via the metal conveyor chain links. Though effective for its intended application, which is to dry the hazardous metal sludge slowly and at low enough temperatures to prevent volatilization of the heavy metals, the process is too slow and inefficient for rapid and cost effective drying of municipal sludge.

SUMMARY OF THE INVENTION

In accordance with the present invention, an apparatus and method for effectively and efficiently drying municipal sewage sludge utilizes a prior art pocketed sludge carrying belt, but uniquely provides a multi-pass drying chamber that provides a combination of direct and indirect heating to both surfaces of the sludge carrying belt as it moves in a continuous pattern through the drying chamber. The result is rapid and thorough drying of the sludge on a high volume basis necessary for cost effective treatment.

The apparatus of the present invention includes a continuous conveyor belt which has an open cellular construction defined by open ended pockets. Means are provided for supplying moist sludge to the conveyor belt and for pressing the sludge into the pockets to fill the belt with sludge. The conveyor belt is supported for movement through a drying chamber in a multi-pass manner including an initial drying run and an inverted return drying run. The means for supporting the conveyor belt in each of the runs includes a planar heat conducting surface positioned to support the underside of the conveyor belt along the respective run. Means are also provided for directing heated air against the heat conducting supporting surface and directly against the opposite unsupported surface of the sludge filled conveyor belt on each of the runs.

The conveyor belt may be of a type known in the prior art and comprising a series of interconnected metal links having flat side walls which extend generally vertically in use to define the pockets for the sludge. Preferably, the initial and return runs of the conveyor belt are disposed in vertically spaced parallel relation and the means for directing heated air comprises an upper air plenum which is mounted over the upper of said conveyor belt runs and has an air outlet face which lies parallel to and spaced above the upper surface of the sludge-filled belt for that run, a lower air plenum which is mounted under the lower of the belt runs and includes an air outlet face which lies parallel to and spaced below the heat conducting supporting surface for that lower run, and an intermediate air plenum which is mounted between the runs and has upper and lower air outlet faces which lie parallel to and spaced, respectively, below the heat conducting supporting surface for the upper run and above the upper surface of the sludge-filled belt for the lower run. In the preferred embodiment, each of the air outlet faces of the plenums is provided with a plurality of air discharge nozzles. The discharge nozzles comprise parallel slots which extend laterally across the width of the conveyor belt runs and are spaced longitudinally along the paths of the runs.

The support for the conveyor belt includes a cylindrical heated drum or pulley around which the belt travels between the initial drying run and the inverted return drying run. Means are also provided for removing dry sludge from the conveyor belt at the end of the inverted return run. Preferably the sludge supplying means is positioned above the conveyor belt at the upstream end of the initial drying run and the sludge removing means is positioned directly below the sludge supplying means. An additional drying run may also be provided by directing the inverted run around a second cylindrical pulley and supporting the added run for movement in the same direction as the initial drying run. This modified arrangement allows unidirectional processing.

In accordance with the method of the present invention, the steps for drying moist sludge include: pressing the sludge into an open cellular conveyor belt which defines a series of open ended pockets and compacting the sludge in the pockets to fill the belt uniformly; moving the belt in a closed path which includes an initial drying run supported by a first planar heat conducting surface and an inverted return drying run which is supported by a second planar heat conducting surface; and, directing heated air against the heat conducting supporting surfaces and the opposite unsupported surfaces of the sludge filled belt in both conveyor belt runs.

In a variant method, moist sludge is dried by providing a continuous conveyor belt of an open heat-conducting construction comprising a series of open-ended metal links; supporting the conveyor belt for travel in a closed loop including a pair of spaced generally parallel forward and return belt runs; filling the conveyor belt with moist sludge; moving the belt through the closed loop; heating one side of the sludge-filled belt in each run by direct impingement of heated air; and, heating the opposite side of the sludge-filled belt in each run by indirect conduction heating. The forward and return runs are generally horizontal and each of the runs is supported from below with a planar heat conducting surface. In accordance with the preferred method, the conveyor belt is inverted between the forward and return runs.

BRIEF DESCRIPTION OF THE DRAWINGS

FIG. 2 is a sectional end view of the apparatus of FIG. 1 taken on line 2—2 thereof.

FIG. 3 is an enlarged partial sectional view taken on line 3—3 of FIG. 2.

FIG. 4 is an enlarged sectional detail of the drying air nozzles shown in FIG. 3.

FIG. 6 is a side elevation view of the sludge supply and discharge end of the apparatus of the present invention.

FIG. 7 is an end elevation of the apparatus shown in FIG. 6.

DETAILED DESCRIPTION OF THE PREFERRED EMBODIMENT

Figures 1, 5:
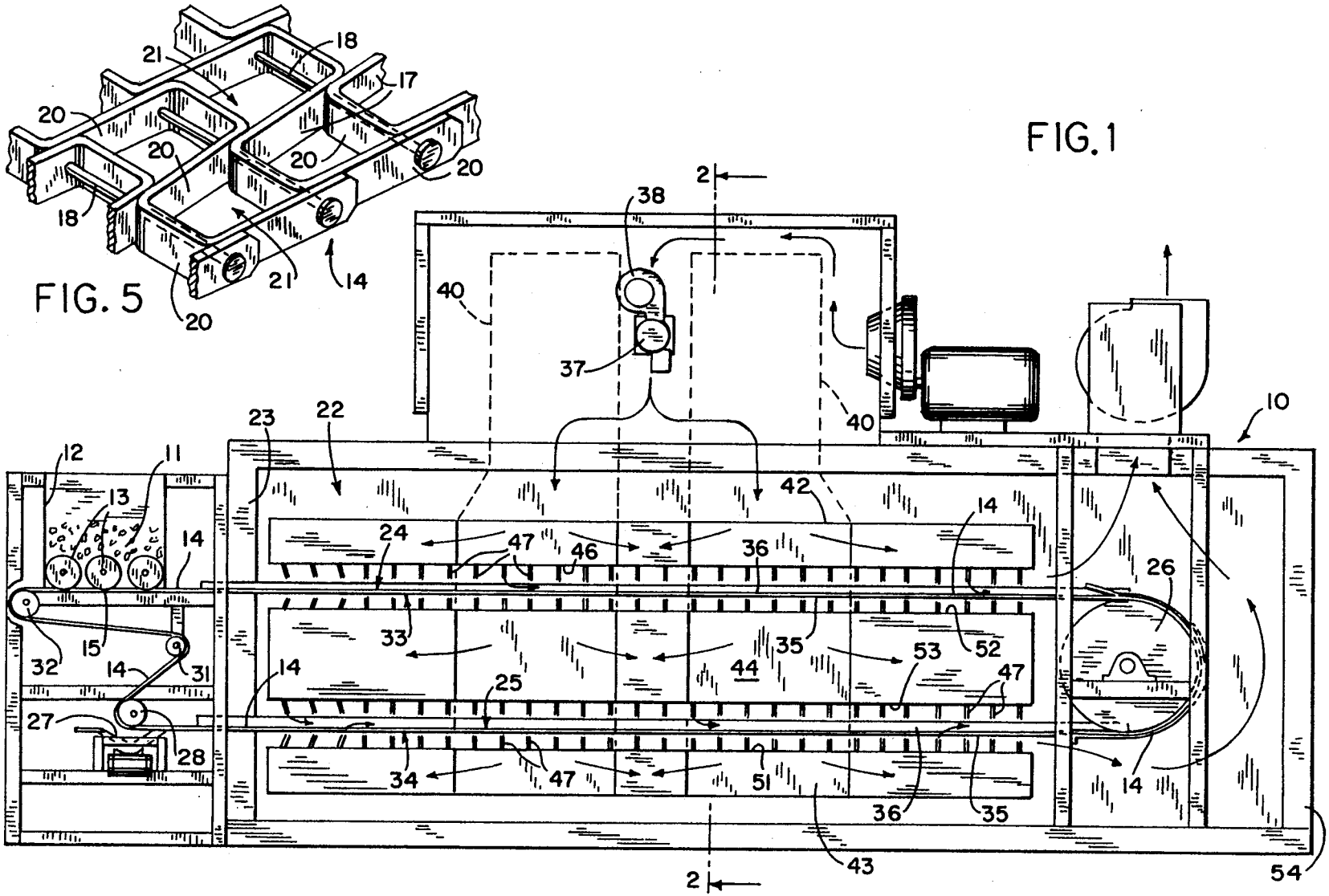
FIG. 1 is a sectional side elevation of the apparatus of the present invention.
FIG. 5 is a perspective view of a metal link conveyor belt of a type suitable for use in the apparatus of the present invention.

The apparatus and method of the present invention are adapted to reduce the water content of moist municipal sludge and to simultaneously kill or render harmless any pathogenic organisms contained therein, to place the dried sludge in a condition for direct land application under applicable government standards. The moist municipal sludge is supplied to the sludge dryer 10 of the present invention in the form of broken pieces of sludge cake 11 after preliminary dewatering in a filter press or the like. The sludge cake 11 may have, for example, 80% by weight moisture and must be dried in the sludge dryer 10 to reduce the moisture content to at least about 10% in a high temperature environment which will effectively eliminate all pathogenic organisms.

Referring initially to FIGS. 1, 2, 6 and 7, the sludge cake 11 is initially supplied to an inlet hopper 12 at the bottom of which are mounted a series of counter rotating paddles 13. The bottom of the hopper 12 is open and a sludge-carrying conveyor belt 14 is mounted for horizontal movement below the hopper on a flat horizontal support plate 15. The paddles 13 and the conveyor belt 14 may be driven by separate respective drive motor/reducers 16 and 19 via suitable drive belt connections.

Referring also to FIG. 5, the conveyor belt 14 is made of a series of interconnected metal links 17 pivotally interconnected by laterally extending connecting pins 18. The flat metal side bars and end walls 20 of the chain links provide a cellular construction for the conveyor belt which defines a series of open ended pockets 21 for the receipt of moist sludge and conveyance thereof through the drying chamber 22 of the dryer. The paddles 13 may be driven to rotate in the directions indicated by the arrows in FIG. 6 to further reduce the size of the pieces of sludge cake 11 and carry the pieces downwardly through the lower hopper opening where the sludge is pressed uniformly into the pockets 21 in the conveyor belt 14, as the belt passes beneath the hopper on the support plate 15.

The sludge hopper 12 is separated from the drying chamber 22 by an insulated end wall 23 which is provided with a narrow horizontal slot to allow passage of the sludge filled conveyor belt 14. In the preferred embodiment, the conveyor belt 14 is supported for passage through the drying chamber 22 in an upper initial drying run 24 and a lower return run 25, between which the belt passes around a large diameter drum-like pulley 26 where the conveyor belt 14 is inverted from the upper run to the lower return run. At the downstream end of the lower return run 25, the belt 14 passes through another opening in the end wall 23 of the drying chamber and over a laterally oriented discharge conveyor 27 into which dried sludge nuggets are deposited after removal from the belt. As may best be seen in FIGS. 5, 6 and 7, the conveyor belt is supported to pass around a waffle roll 28, rotatably positioned above the discharge conveyor 27, which roll is provided with a uniform pattern of protruding feet 30 which fit into the links 17 of the conveyor belt and push the dried sludge nuggets out of the pockets and onto the discharge conveyor. The conveyor belt continues to pass around a take-up pulley 31 and then to a set of head sprockets 32, coaxially mounted on head shaft 29, from which the belt 14 returns for passage beneath the hopper 12 to be refilled with moist sludge.

The sludge filled conveyor belt 14 is supported within the drying chamber 22 along the full lengths of the initial upper drying run 24 and the lower return drying run 25 by upper and lower support pans 33 and 34, respectively. The support pans 33 and 34 are of sheet metal construction and each includes a lower planar heat conducting surface 35 between a pair of vertical lips 36 extending along the opposite lateral edges of the surface 35. Each of the pans 33 and 34 extends to near tangent contact with the outer surface of the pulley 26 to provide a smooth surface transition for the conveyor belt 14 onto and off of the pulley.

Heated air for drying the sludge carried in the conveyor belt 14 is provided by a gas heater 37 and circulated through a suitable system of duct work by a motor-driven blower 38. Heated air is directed by the blower 38 into a main generally vertically oriented supply duct 40 to a series of air plenums which essentially enclose both the upper and lower runs 24 and 25, respectively, of the conveyor belt 14. An upper air plenum 42, a lower air plenum 43 and an intermediate air plenum 44 are mounted in spaced parallel relation to essentially enclose the conveyor belt runs and to supply heated air to the upper and lower surfaces thereof. Each of the air plenums 42–44 is supplied with heated air from the main supply duct 40 by a lateral distribution duct 41. To ensure uniform distribution of drying air to the plenums 42–44, the lateral distribution ducts 41 for the upper air plenum 42 and intermediate air plenum 44 may be provided with adjustable dampers 45. The upper air plenum 42 includes a lower air outlet face 46 which is provided with a series of nozzles 47 to direct heated air onto the upper surface of the sludge filled conveyor belt traveling along the initial upper run 24. Each nozzle 47 comprises a narrow slot extending laterally across the conveyor belt and spanning the full width thereof. Each nozzle 47 is defined by a pair of generally vertically oriented nozzle plates 50, the free edges of which define therebetween the slot 48 which may have a nominal width of ⅜ inch (9.5 m). The slots may be spaced longitudinally along the plenum at intervals of about 6 inches (15 cm).

The lower air plenum 43 has an upper air outlet face 51 which lies parallel to and is spaced below the lower heat conducting surface 35 supporting the lower conveyor belt run 25. In a similar manner, the upper outlet face 51 is provided with a series of nozzles 47 through which heated air is directed against the underside of the heat conducting surface 35. The intermediate air plenum 44 is provided with both upper and lower air outlet faces 52 and 53, respectively. These faces are also provided with a series of nozzles 47 arranged similarly as described with respect to the upper and lower air plenums 42 and 43.

It will be seen that each of the patterns of nozzles 47 in the lower outlet faces 46 and 53 of the upper and intermediate plenums 42 and 44, respectively, provide flows of heated drying air directly against the upper surface of the sludge filled conveyor belt 14 in both the upper and lower runs 24 and 25 thereof. Simultaneously, heated drying air is being supplied through the arrangement of nozzles 47 in the upper outlet faces 51 and 52 of the lower and intermediate air plenums 43 and 44, respectively, against the heat conducting supporting surfaces 35 for the respective lower and upper runs 25 and 24 of the sludge filled conveyor belt. Because the conveyor belt is inverted as it passes around the pulley 26 in traversing from the upper to the lower run, each surface of the sludge filled belt 14 receives a flow of directly and indirectly supplied heated drying air as the belt passes through the drying chamber 22. The indirect supply of heated air against the heat conducting supporting surfaces 35 for the conveyor belt heats the sludge by conduction, with the heat transmitted through the metal surface 35 and into the metal side bars and end walls 20 of the links 17 forming the conveyor belt. This somewhat slower and more uniform application of heat is supplemented by the direct application of heated air to the exposed upper surfaces of the sludge filled conveyor belt in both conveyor runs. As a result, the capacity of the sludge dryer 10 is substantially increased over devices of the prior art and the sludge is quickly and efficiently dried to lower the moisture content to a level suitable for direct land application. At the same time, pathogenic organisms are effectively destroyed.

Even though the small cakes or nuggets of sludge which are pressed into the pockets 21 of the conveyor belt are subjected to unsupported movement around approximately one-half the circumference of the pulley 26 as the conveyor belt moves from the initial upper run to the lower return run, it has been found that the sludge nuggets are not subject to premature loosening and dislodgement from the conveyor belt. Municipal sludge contains high quantities of hair and other fibrous materials which are believed to act to hold the sludge nuggets together even though there is some flexing of the links forming the conveyor belt as it traverses the curved surface of the pulley. In addition, the sludge has only been partly dried in its movement on the belt through the initial upper run 24 and thus tends to adhere to the belt somewhat better than sludge which has been fully dried at the end of the lower run. It should be noted that the drum or pulley 26 is also heated because of its location in the drying chamber 22 and thus effectively extends the indirect drying provided by the upper supporting surface 35.

In order to help reduce heat loss from the drying chamber 22 through the narrow openings in the end wall 23 where the conveyor belt enters and leaves the chamber, the first few nozzles 47, above and below the upper and lower runs 24 and 25, may be positioned to angle their air flows away from the end wall 23 by positioning the nozzle plates 50 at a slight angle toward the interior of the drying chamber, as shown in FIGS. 1 and 3. Also, it may be more convenient for some sludge processing operations to maintain a continuous unidirectional flow of sludge through the system. The apparatus and method of the present invention are easily adaptable to providing a third drying run within a single drying chamber by adding another pulley 26 near the inlet end wall 23 and another heat conducting supporting surface 35 to support the third run of the conveyor belt. The lower return run 25 of the preferred embodiment would then become an intermediate conveyor belt run and another intermediate air plenum 44 would be placed between the intermediate and new lower runs of the conveyor belt. The new third run of the belt would travel in the same direction as the initial upper run 24 and exit the sludge dryer through the opposite end wall 54.

Various modes of carrying out the present invention are contemplated as being within the scope of the following claims particularly pointing out and distinctly claiming the subject matter which is regarded as the invention.

I claim:

1. An apparatus for drying moist sludge, which sludge has a high initial water content, said apparatus comprising:

a continuous conveyor belt having an open cellular construction defined by open ended pockets;

means for supplying moist sludge to the conveyor belt and for pressing the sludge into said pockets to fill the belt with sludge;

a drying chamber including means for supporting the conveyor belt for movement therein along an initial drying run and an inverted return drying run, said supporting means for each of said runs comprising a planar heat conducting surface positioned to support the underside of the conveyor belt along the respective runs; and, means for directing heated air against the heat conducting supporting surface and directly against the opposite unsupported surface of the sludge-filled belt on each of said runs.

2. The apparatus as set forth in claim 1 wherein said conveyor belt comprises a series of interconnected metal links having flat generally vertically extending side walls defining said pockets.

3. The apparatus as set forth in claim 1 wherein said initial and return runs of the conveyor belt are disposed in vertically spaced parallel relation and wherein said air direction means comprises:

an upper air plenum mounted over the upper one of said conveyor belt runs and having an air outlet face lying parallel to and spaced above the upper surface of said sludge-filled belt for said upper run;

a lower air plenum mounted under the lower one of said conveyor belt runs and having an air outlet face lying parallel to and spaced below the heat conducting supporting surface for said lower run; and, an intermediate air plenum mounted between said runs and having upper and lower air outlet faces lying parallel to and spaced, respectively, below the heat conducting supporting surface for said upper run and above the upper surface of said sludge-filled belt for said lower run.

4. The apparatus as set forth in claim 3 comprising a plurality of discharge nozzles in the outlet faces of each of said plenums.

5. The apparatus as set forth in claim 4 wherein said discharge nozzles comprise parallel slots extending laterally across the width of the conveyor belt runs and spaced longitudinally therealong.

6. The apparatus as set forth in claim 1 wherein said conveyor belt supporting means includes a cylindrical pulley around which said conveyor is caused to travel between said initial drying run and said inverted return run.

7. The apparatus as set forth in claim 6 including means for removing dry sludge from the conveyor belt.

8. The apparatus as set forth in claim 7 wherein said sludge supplying means is positioned above said conveyor belt at the upstream end of said initial drying run and said sludge removing means is positioned at the downstream end of said inverted return drying run and below said supplying means.

9. A method for drying moist sludge comprising the steps of:

(1) pressing the sludge into an open cellular conveyor belt defining a series of open ended pockets and compacting the sludge in said pockets to fill the belt with sludge;

(2) moving the belt in a closed path including an initial drying run supported by a first planar heat conducting surface and an inverted return drying run supported by a second planar heat conducting surface; and, (3) directing heated air against the heat conducting supporting surfaces and the opposite unsupported surfaces of the sludge-filled belt.

10. A method for drying moist sludge comprising the steps of:

(1) providing a continuous conveyor belt of an open heat-conducting construction comprising a series of open-ended metal links;

(2) supporting said conveyor belt for travel in a closed loop including a pair of spaced generally parallel forward and return belt runs;

(3) filling said conveyor belt with moist compacted sludge;

(4) moving the belt in a closed loop;

(5) heating one side of the sludge-filled belt in each run by direct impingement of heated air; and, (6) heating the opposite side of the sludge-filled belt in each run by indirect conduction heating.

11. The method as set forth in claim 10 wherein said forward and return runs are generally horizontal and each of said runs is supported from below with a planar heat conducting surface.

12. The method as set forth in claim 11 including the step of inverting said conveyor belt between said forward and return runs.

* * * * *